US006964118B2

(12) United States Patent
Parisotto et al.

(10) Patent No.: US 6,964,118 B2
(45) Date of Patent: Nov. 15, 2005

(54) CRAMPON, MOUNTAIN BOOT AND RELATIVE FASTENING SYSTEM

(75) Inventors: Davide Parisotto, Casella d'Asolo (IT); Gioachino Gobbi, Courmayeur (IT)

(73) Assignees: Calzaturificio S.C.A.R.P.A. S.p.A, Asolo (IT); Grivel S.r.l., Courmayeur (IT)

( * ) Notice: Subject to any disclaimer, the term of this patent is extended or adjusted under 35 U.S.C. 154(b) by 99 days.

(21) Appl. No.: 10/136,762

(22) Filed: Apr. 30, 2002

(65) Prior Publication Data

US 2002/0189133 A1 Dec. 19, 2002

(30) Foreign Application Priority Data

Apr. 30, 2001 (EP) ..... 01830284

(51) Int. Cl.[7] ..... A43C 15/06
(52) U.S. Cl. ..... 36/7.6; 36/62
(58) Field of Search ..... 36/7.6, 7.5, 132, 36/62, 64, 3 B

(56) References Cited

U.S. PATENT DOCUMENTS 741,349 A * 10/1903 Link ..... 36/62
784,119 A * 3/1905 Norlund et al. ..... 36/64
1,535,207 A * 4/1925 Dorff ..... 36/3 B
2,107,617 A * 2/1938 Oetterer ..... 36/62
3,685,173 A * 8/1972 Piazza ..... 36/7.6
4,245,409 A 1/1981 Beyl
4,620,375 A 11/1986 Wallace
4,679,335 A * 7/1987 Berlese ..... 36/3 B
6,196,556 B1 * 3/2001 Bonaventure et al. ..... 36/3 B
6,481,121 B1 * 11/2002 Tucker ..... 36/62

FOREIGN PATENT DOCUMENTS

CH 230 621 A 1/1944
CH 593 031 A 11/1977
CH 656052 * 6/1986

OTHER PUBLICATIONS

Translation of CH 593031.*

* cited by examiner

*Primary Examiner*—Ted Kavanaugh
(74) *Attorney, Agent, or Firm*—Myers, Dawes, Andras & Sherman, LLP

(57) ABSTRACT

A fastening system for fastening a crampon to a mountain boot having a sole; the fastening system having at least one fastening seat formed in the sole of the mountain boot, and at least one fastening member carried by the crampon and which engages the fastening seat to fix the crampon to the mountain boot.

12 Claims, 4 Drawing Sheets

CRAMPON, MOUNTAIN BOOT AND RELATIVE FASTENING SYSTEM

The present invention relates to a crampon, a mountain boot, and a relative fastening system.

More specifically, the present invention relates to a crampon, and to a generic mountain boot, e.g. for mountaineering, trekking, ski mountaineering and similar, to which the following description refers purely by way of example.

BACKGROUND OF THE INVENTION

As is known, crampons are fixed under the sole of mountain boots to improve the grip and stability of the user on ground or walls covered with packed snow or ice.

Currently known crampons normally comprise a front and a rear plate, which are fixed respectively under the front and rear portion of the sole of the boot, are normally hinged to each other to allow the structure a certain amount of flexibility when walking, and have a number of bottom spikes projecting from the peripheral edge of the two plates, in the opposite direction to the sole of the boot, so as to penetrate the layer of ice or packed snow when the boot rests on the ground.

Crampons also comprise a number of front spikes projecting frontwards from the front edge of the front plate, and by which to drive the toe of the boot into the layer of ice or packed snow when climbing substantially vertical walls.

As is known, crampons are currently fixed to the sole of mountain boots by means of a front fastening bracket and a rear fastening device fixed to the front and rear plate respectively.

The front fastening bracket locks the toe of the boot to the front plate of the crampon, and is defined by a U-shaped metal bar hinged at both ends to the front plate of the crampon to form, with the front plate, a closed ring engaged by the front portion of the sole of the boot.

The rear fastening device locks the rear portion of the boot to the rear plate of the crampon, and comprises a lock lever which clamps onto the heel of the boot to keep the toe of the boot resting against the front fastening bracket; and a supporting bracket connecting the lock lever to the rear plate.

Crampons also comprise a safety strap which is fastened about the instep of the boot to prevent the lock lever of the rear fastening device from working out of the lock position clamped onto the heel of the boot to keep the toe of the boot resting against the front fastening bracket.

Crampons of the above type have the major drawback of working loose relatively easily when used on mountain boots with particularly soft vamps.

Mountain boots with soft vamps, in fact, are extremely flexible, so that the tip of the sole may easily work loose from the front fastening bracket of the crampon, thus resulting in total or partial detachment of the crampon from the boot.

To eliminate the above drawback, known crampons are equipped with auxiliary straps, which are fastened about the vamp of the boot, at the forefoot and instep, to fasten the front plate of the crampon more securely to the sole of the boot.

Securing the crampon to the boot using auxiliary straps, however, conflicts with the need to ensure long-term comfort.

In the case of particularly soft vamps, the auxiliary straps exert considerable pressure on the vamp, which may impair circulation of the blood to the foot, thus resulting, when walking for prolonged periods, in severe fatigue and possibly also inflammation of the foot.

SUMMARY OF THE INVENTION

It is an object of the present invention to provide a crampon and a mountain boot designed to eliminate the aforementioned drawbacks.

According to the present invention, there is provided a fastening system for fastening a crampon to a mountain boot comprising a sole; said fastening system being characterized by comprising at least one fastening seat formed in the sole of said mountain boot; and at least one fastening member carried by said crampon and which engages said fastening seat to fix said crampon to said mountain boot.

According to the present invention, there is also provided a mountain boot comprising a vamp and a sole fixed to the bottom portion of the vamp; said mountain boot being characterized by comprising at least one fastening seat formed in said sole.

According to the present invention, there is also provided a crampon comprising at least one plate and at least one spike projecting from said plate; said crampon being characterized by comprising at least one fastening member fixed rigidly to said plate; and said fastening member projecting at least partly over said plate to engage a fastening seat formed in a mountain boot, so as to fix said crampon to said mountain boot.

BRIEF DESCRIPTION OF THE DRAWINGS

A non-limiting embodiment of the present invention will be described by way of example with reference to the accompanying drawings, in which.

DETAILED DESCRIPTION OF THE INVENTION

Figure 1:
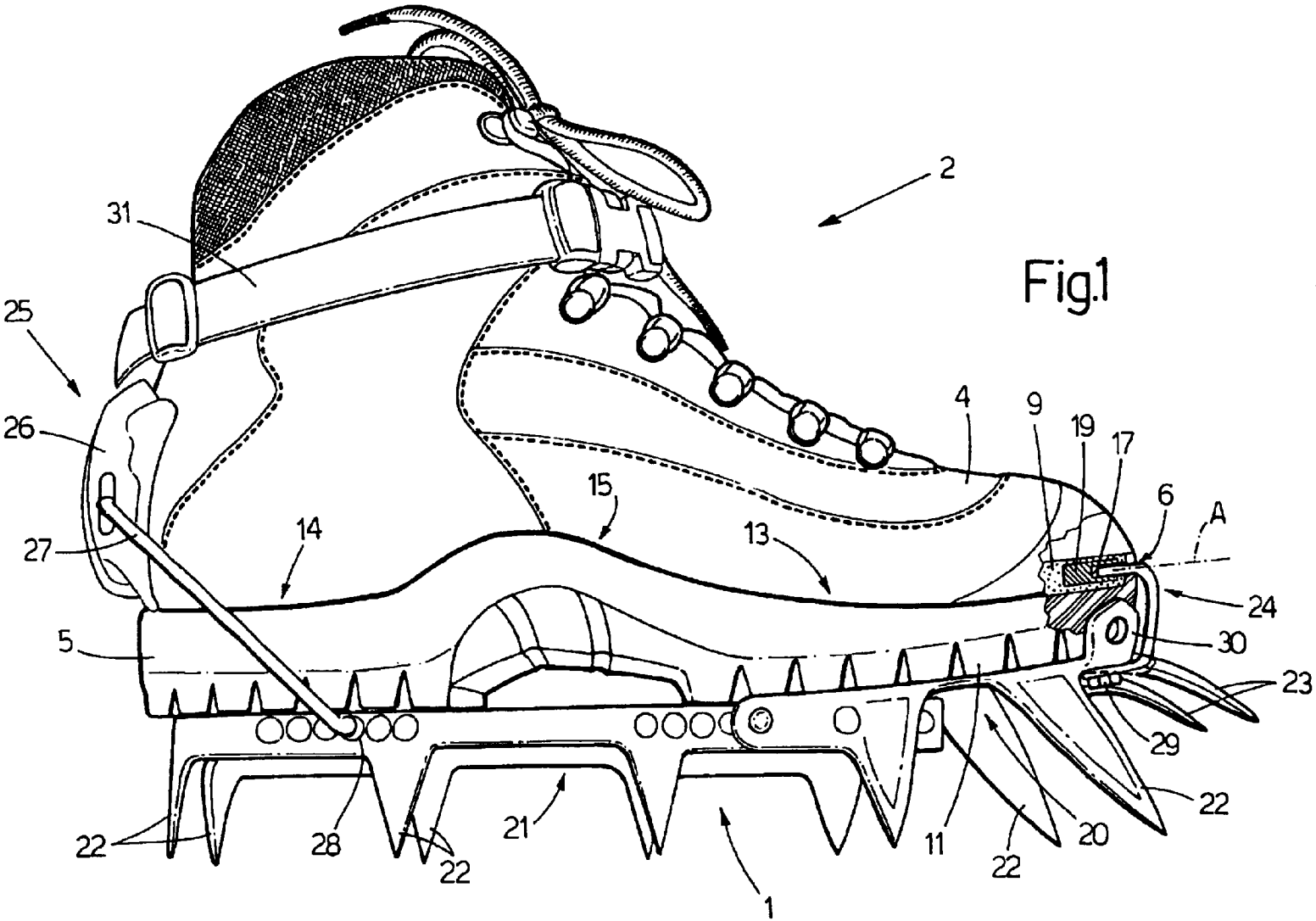
FIG. 1 shows a side view in perspective, with parts removed for clarity, of a mountain boot and a crampon in accordance with the teachings of the present invention.

Numbers 1 and 2 in FIG. 1 indicate respectively a crampon and a mountain boot connected to each other by an original fastening system described in detail below.

Mountain boot 2 comprises an appropriately shaped vamp 4 of leather or similar; and a sole 5 fixed to the bottom portion of vamp 4, and the tip of which comprises at least one fastening seat 6 by which to fasten crampon 1 to mountain boot 2.

Figure 2:
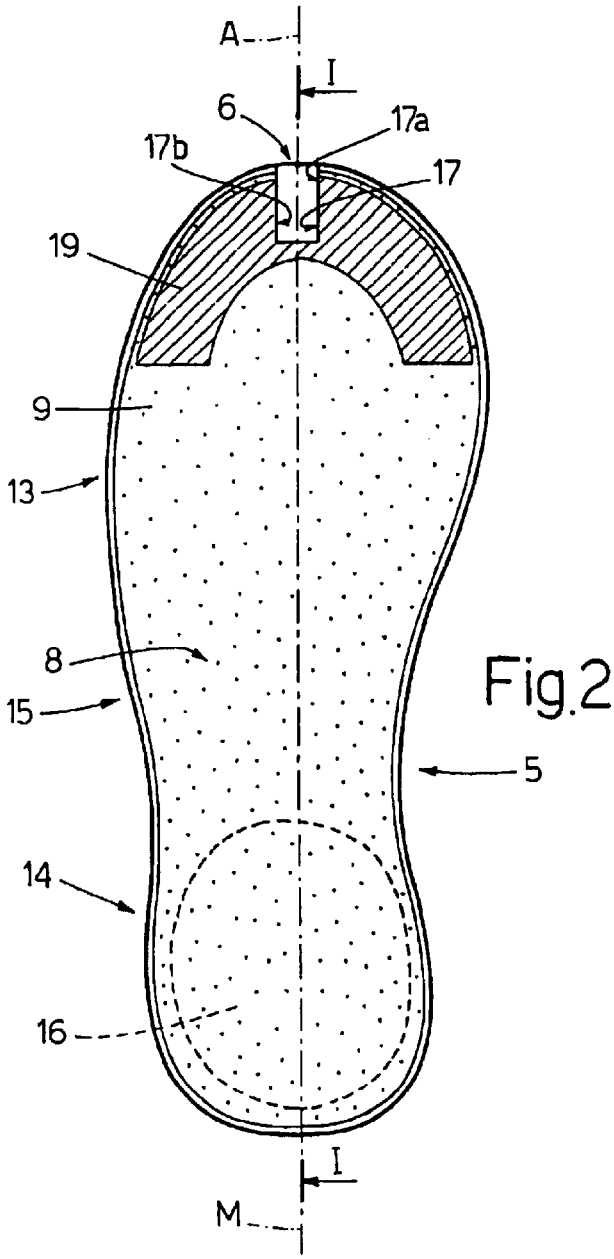
FIG. 2 shows a top plan view of the sole of the FIG. 1 mountain boot.
Figure 3:
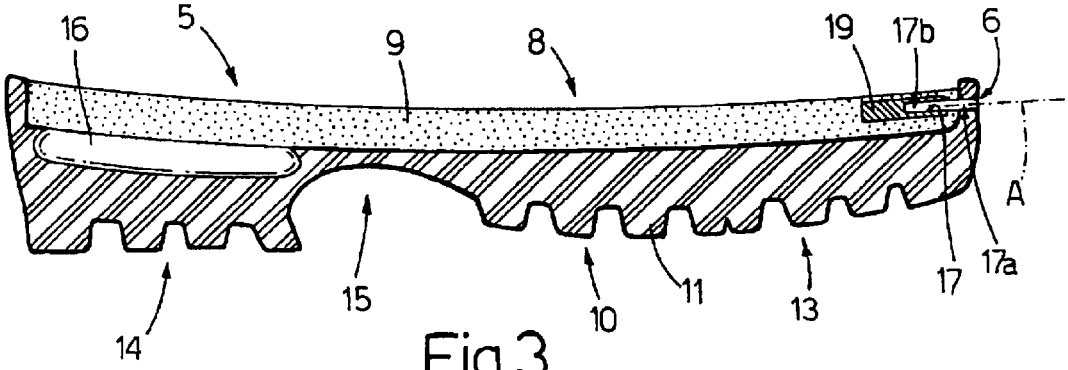
FIG. 3 shows a section of the mountain boot sole along line I—I in FIG. 2.

With reference to FIGS. 2 and 3, in the example shown, sole 5 is made of rubber and comprises a reinforcing inner sole 9 for increasing the stiffness of sole 5. In the example shown, sole 5 comprises a top face 8 stitched or glued to inner sole 9; and a bottom face 10 having a tread 11 on which crampon 1 rests.

Sole 5 comprises a front or forefoot portion 13; a rear or heel portion 14; and an intermediate portion 15 located at the arch of the foot. At rear portion 14, sole 5 comprises an insert 16 of shock-absorbing material, i.e. material for absorbing shock by the heel; and the tip of sole 5 comprises said fastening seat 6 in front portion 13.

With reference to FIGS. 1, 2, 3 and 6, fastening seat 6 extends inwards of, and from the tip of, sole 5, and is coaxial with a longitudinal axis A which, in the example shown, is coplanar with a center-line plane M of sole 5 and substantially parallel to top face 8 and bottom face 10 of sole 5.

In the example shown, fastening seat 6 is defined by a dead hole 17 which preferably, though not necessarily, has a rectangular section and extends inwards, i.e. towards inner sole 9, from the outer surface of sole 5. In the example shown, dead hole 17 comprises an initial portion 17*a* formed in the rubber part of the tip of front portion 13; and an end portion 17*b* formed in the front portion of inner sole 9.

With reference to FIGS. 1, 2 and 3, in the example shown, the front portion of inner sole 9 comprises a reinforcing insert 19 made of extremely rigid material, and in which end portion 17*b* of dead hole 17 is formed to impart a high degree of stiffness to fastening seat 6.

In the example shown, reinforcing insert 19 is defined by a horseshoe-shaped metal insert embedded in the rest of inner sole 9.

It should be pointed out that inner sole 9 is preferably, though not necessarily, made of two-component plastic material, so as to have a front portion stiffer than the rear portion over insert 16 of shock-absorbing material.

It should also be pointed out that sole 5 may even be made entirely of rigid material, in which case, reinforcing inner sole 9 is optional.

With reference to FIGS. 1, 4, 5 and 6, crampon 1 comprises a front plate 20 and a rear plate 21, which are fixed beneath sole 5 of mountain boot 2 and rest on tread 11 at front portion 13 and rear portion 14 of sole 5 respectively.

Front plate 20 and rear plate 21 are made of metal, are preferably, though not necessarily, hinged to each other to impart a certain amount of flexibility to the structure and permit deformation of sole 5 of mountain boot 2 when walking, and comprise a number of bottom spikes 22, which project from the peripheral edge of front plate 20 and rear plate 21, on the opposite side to the face of the two plates on which sole 5 of mountain boot 2 rests, so as to penetrate the layer of ice or packed snow when mountain boot 2 rests on the ground.

Crampon 1 also comprises two front spikes 23 projecting from the front portion of the peripheral edge of front plate 20, and directed frontwards with respect to crampon 1 to enable the toe of mountain boot 2 to be driven into the layer of ice or packed snow.

Figure 4:
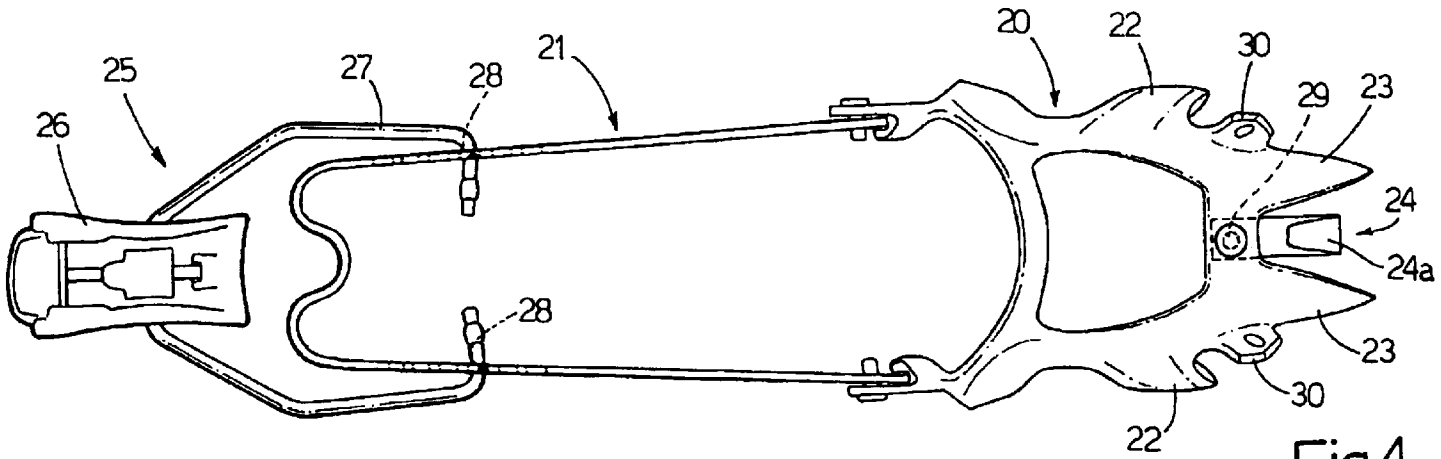
FIG. 4 shows an overview in perspective of the crampon according to the teachings of the present invention.
Figure 5:
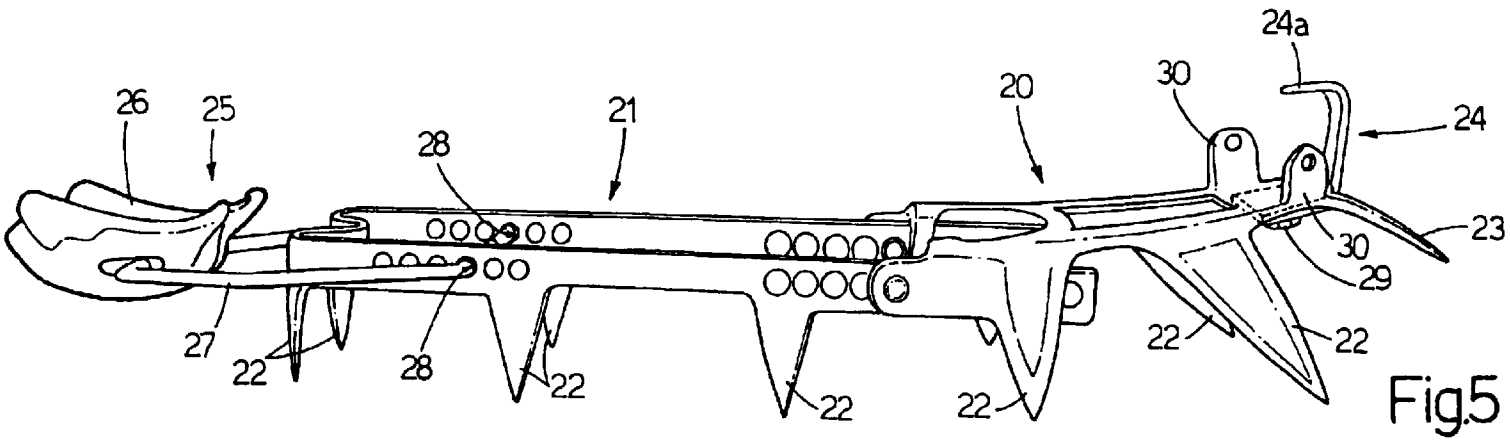
FIG. 5 shows a side view in perspective of the FIG. 4 crampon.
Figure 6:
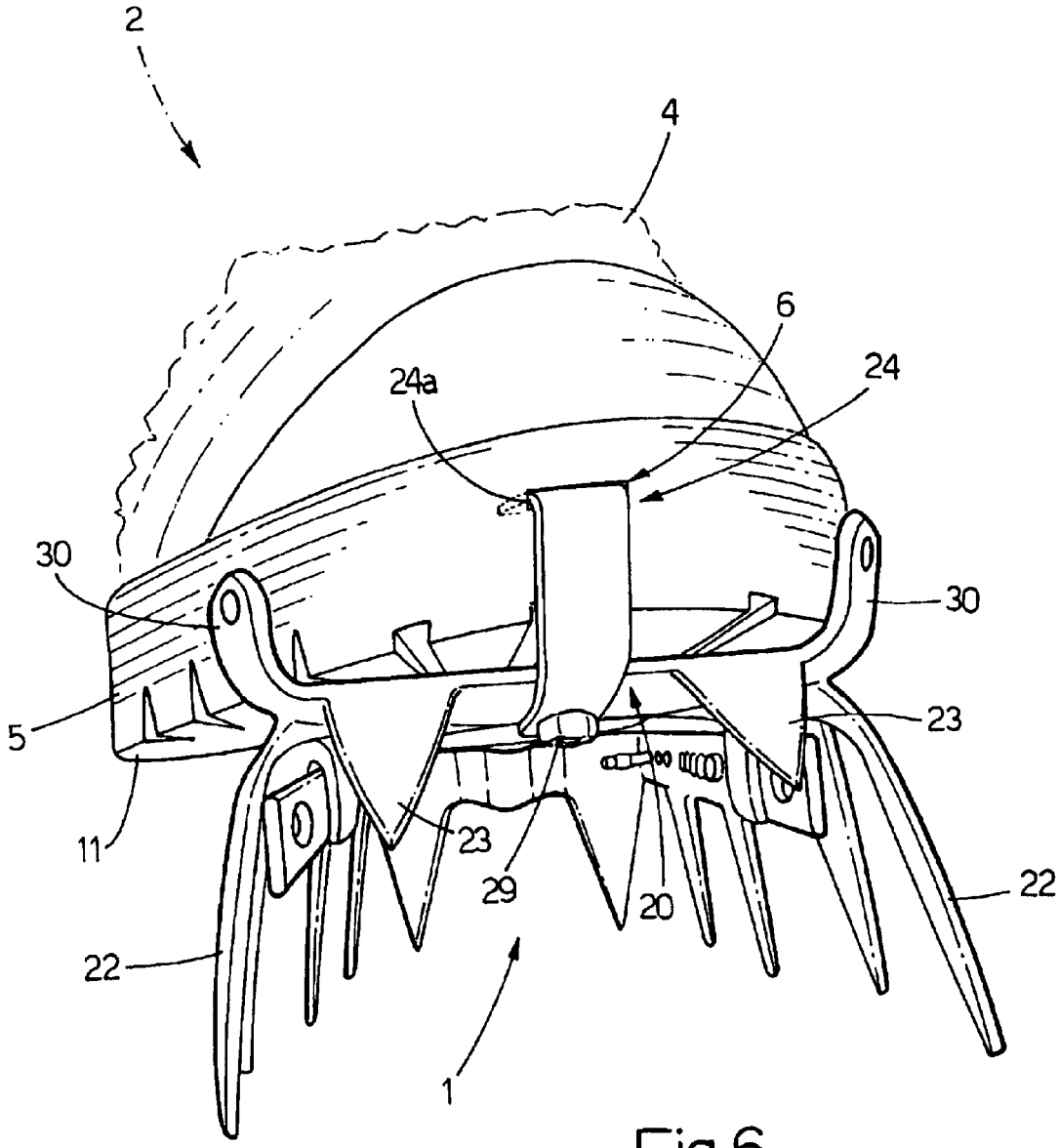
FIG. 6 shows a front view in perspective of a detail of the system for fastening the mountain boot and crampon shown in FIG. 1.

With reference to FIG. 4, front plate 20 is designed to fit, as stated, onto the underside of front portion 13 of sole 5, and is substantially trapezoidal in shape with a central through hole to avoid accumulating snow or ice; and rear plate 21 is designed to fit onto the underside of rear portion 14 of sole 5, and is defined by a rectangular-section, substantially U-shaped bar with the two ends hinged to front plate 20.

With reference to FIGS. 1, 4, 5 and 6, crampon 1 also comprises a front fastening member 24 for fastening front plate 20 of crampon 1 to the front portion 13 of sole 5 of mountain boot 2; and a rear fastening device 25 for selectively locking the rear portion of mountain boot 2 to rear plate 21 of crampon 1.

More specifically, front fastening member 24 is fixed rigidly to the tip of front plate 20, and is shaped to engage fastening seat 6 in mountain boot 2 to connect crampon 1 to mountain boot 2.

More specifically, front fastening member 24 is defined by a curved, hook-shaped appendix 24 projecting from front plate 20, between the two front spikes 23, so that its free end 24*a* is located over front plate 20, i.e. on the opposite side to bottom spikes 22, to engage fastening seat 6 in the toe of mountain boot 2.

In the example shown, appendix 24 is defined by a rigid, substantially C-shaped metal section having a cross section complementary to that of fastening seat 6, i.e. a rectangular section complementary to that of dead hole 17, and fixed to the tip of front plate 20 so as to project over front plate 20.

More specifically, in the example shown, appendix 24 is fixed to front plate 20 by a bolt 29 or similar, to enable appendix 24 to be changed, in the event provision is made for appendixes 24 of different sizes for different types of mountain boots 2.

It should be pointed out that appendix 24 may even be formed in one piece with front plate 20, or welded directly to the front portion of the peripheral edge of front plate 20, between the two front spikes 23.

It should also be pointed out that appendix 24 and front plate 20 may be so connected as to adjust the distance between the free end 24*a* of appendix 24 and the face of front plate 20 on which sole 5 rests, so as to adjust the position of free end 24*a* of appendix 24 according to the thickness of sole 5 of mountain boot 2.

Rear fastening device 25 comprises a lock lever 26 which clamps onto the heel of mountain boot 2 to keep the toe of the boot resting on appendix 24 with free end 24*a* inside fastening seat 6 in the tip of sole 5; and a supporting bracket 27 for connecting lock lever 26 to rear plate 21.

More specifically, supporting bracket 27 is U-shaped with the two free ends inserted inside two adjusting holes 28 formed in the sides of rear plate 21; and lock lever 26 pivots on the central portion of supporting bracket 27, and is movable to and from a lock position in which one end of the lever rests on the rear end of sole 5, and the side of the lever rests on the heel of mountain boot 2, so as to push and keep the toe of mountain boot 2 against appendix 24, and so that the free end 24*a* of hook-shaped appendix 24 engages fastening seat 6 in the tip of sole 5.

Crampon 1 preferably, though not necessarily, also comprises a safety strap 31, which fastens about the instep of mountain boot 2 to prevent lock lever 26 of rear fastening device 25 from working out of the lock position clamped onto the heel of mountain boot 2 to keep the toe of mountain boot 2 resting on appendix 24.

The system for fastening crampon 1 to mountain boot 2 therefore comprises fastening seat 6 in the toe of the mountain boot; hook-shaped appendix 24 fixed to front plate 20 of crampon 1; and rear fastening device 25 fixed to rear plate 21 of crampon 1.

With reference to FIGS. 1, 4, 5 and 6, crampon 1 preferably, though not necessarily, also comprises at least two lateral tabs 30 projecting from front plate 20, on opposite sides of appendix 24, to prevent any lateral movement of mountain boot 2 with respect to front plate 20 of crampon 1.

More specifically, lateral tabs 30 project upwards from the front peripheral edge of front plate 20, on opposite sides of the two front spikes 23, so as to surround and clamp opposite sides of sole 5, i.e. of tread 11.

It should be pointed out that lateral tabs 30 also form part of the fastening system, and serve to prevent any lateral displacement of mountain boot 2 with respect to front plate 20 of crampon 1 from causing free end 24*a* of hook-shaped appendix 24 to withdraw accidentally from fastening seat 6.

In actual use, crampon 1 is fastened to mountain boot 2 by pushing the toe of mountain boot 2, on front and rear plates 20 and 21, against hook-shaped appendix 24, so that the free end 24*a* of appendix 24 engages fastening seat 6 in sole 5, and the two lateral tabs 30 engage the sides of sole 5.

By so doing, the front portion of sole 5 of mountain boot 2 is trapped between the two lateral tabs 30, appendix 24 and front plate 20.

The fastening of crampon 1 to mountain boot 2 is completed by closing rear fastening device 25 onto the heel of mountain boot 2, so as to set lock lever 26 to the lock position.

The major advantage of the above system of fastening crampon 1 to mountain boot 2 lies in eliminating the need for auxiliary straps in the case of soft vamps, thus eliminating any discomfort directly attributable to the use of such straps.

The fastening system described also has the advantage of being fast and easy to use, as well as mass producible at particularly low cost.

Clearly, changes may be made to crampon 1, mountain boot 2 and the system of fastening the two, without, however, departing from the scope of the present invention.

In particular, the vamp 4 of mountain boot 2 may be made entirely of rigid material, e.g. plastic or similar; in which case, fastening seat 6 may obviously be formed entirely in sole 5.

What is claimed is:

1. A fastening system comprising:

a crampon (1) comprising at least one plate (20) and a plurality of bottom spikes (22) projecting from said plate (20);

a mountain boot (2) comprising a sole (5);

at least one fastening seat (6) formed in a front portion of the sole (5) of said mountain boot (2); and at least one fastening member (24) carried by said crampon (1) and which engages said fastening seat (6) to fix said crampon (1) to said mountain boot (2) and further characterized in that said fastening seat (6) is defined by a hole (17) extending inward of said mountain boot (2) from a tip of said sole (5), wherein said fastening member (24) is fixed to a front portion of said plate (20), said fastening member (24) comprising a hook-shaped appendix (24) that projects at least partly over said plate (20, 21) on an opposite side from said bottom spikes (22).

2. A fastening system as claimed in claim 1, characterized in that the sole (5) of said mountain boot (2) comprises an inner sole (9); said fastening seat (6) being formed partly in said inner sole (9).

3. A fastening system as claimed in claim 2, characterized in that said inner sole (9) comprises a rigid insert (19) in which said fastening seat (6) is partly formed.

4. A fastening system as claimed in claim 1, characterized in that said crampon (1) comprises two front spikes (23) projecting frontward from said front portion of said plate (20), wherein said appendix (24) projects from said plate (20) between said two front spikes (23).

5. A fastening system as claimed in claim 4, characterized by comprising at least two lateral tabs (30) projecting upwards from the plate (20), (21) of said crampon (1) to prevent any lateral displacement of said mountain boot (2) with respect to said plate (20), (21).

6. A fastening system as claimed in claim 1, characterized by comprising a rear fastening device (25) carried by said crampon (1) and for locking the rear portion of said mountain boot (2) to said crampon (1).

7. A fastening system as claimed in claim 1, characterized in that said hole (17) has a first cross-sectional shape, and said fastening member (24) has a second cross-sectional shape complementary to said first cross-sectional shape.

8. A fastening system as claimed in claim 7, characterized in that said first cross-sectional shape and said second cross-sectional shape are substantially rectangular.

9. A fastening system for use in connection with a mountain boot (2) comprising:

a vamp (4);

a sole (5) fixed to the bottom portion of the vamp (4);

at least one fastening seat (6) formed in a front portion of said sole (5);

a hook-shaped appendix (24) fixed rigidly to a crampon (1), said appendix comprising a free end extending at least partly over said crampon (1);

said fastening seat (6) being defined by a hole (17) extending inward of and from a tip of, said sole (5), said hole (17) being coaxial with a longitudinal axis (A) of said sole (5); said hole (17) being configured to receive said appendix (24).

10. A fastening system as claimed in claim 9, characterized in that said sole (5) comprises an inner sole (9); said fastening seat (6) being formed partly in said inner sole (9).

11. A fastening system as claimed in claim 10, characterized in that said inner sole (9) comprises a rigid insert (19) in which said fastening seat (6) is partly formed.

12. A fastening system as claimed in claim 9, characterized in that said hole (17) is substantially rectangular in shape.

* * * * *